US011028860B2

(12) United States Patent
Takada et al.

(10) Patent No.: US 11,028,860 B2
(45) Date of Patent: Jun. 8, 2021

(54) PRESSURE BOOSTER

(71) Applicant: SMC CORPORATION, Chiyoda-ku (JP)

(72) Inventors: Yoshiyuki Takada, Ichikawa (JP); Kengo Monden, Ushiku (JP); Kazutaka Someya, Kashiwa (JP)

(73) Assignee: SMC CORPORATION, Chiyoda-ku (JP)

( * ) Notice: Subject to any disclaimer, the term of this patent is extended or adjusted under 35 U.S.C. 154(b) by 0 days.

(21) Appl. No.: 16/641,867

(22) PCT Filed: May 11, 2018

(86) PCT No.: PCT/JP2018/018386
§ 371 (c)(1),
(2) Date: Feb. 25, 2020

(87) PCT Pub. No.: WO2019/044047
PCT Pub. Date: Mar. 7, 2019

(65) Prior Publication Data

US 2020/0248718 A1 Aug. 6, 2020

(30) Foreign Application Priority Data

Aug. 30, 2017 (JP) ..... JP2017-164945
Feb. 20, 2018 (JP) ..... JP2018-028002

(51) Int. Cl.
*F15B 3/00* (2006.01)

(52) U.S. Cl.
CPC ..... *F15B 3/00* (2013.01)

(58) Field of Classification Search
CPC .. F01L 25/063; F03C 1/10; F15B 3/00; F01B 11/001
See application file for complete search history.

(56) References Cited

U.S. PATENT DOCUMENTS 3,540,348 A * 11/1970 Pennther ..... F01L 25/063 91/306
2008/0223206 A1 9/2008 Igarashi
2014/0150421 A1 6/2014 Sears et al.

FOREIGN PATENT DOCUMENTS

CN 101265925 A 9/2008
CN 204458579 U 7/2015
JP 8-21404 A 1/1996
(Continued)

OTHER PUBLICATIONS

International Search Report dated Jul. 17, 2018 in PCT/JP2018/018386 filed May 11, 2018, 2 pages.
(Continued)

*Primary Examiner* — Abiy Teka
(74) *Attorney, Agent, or Firm* — Oblon, McClelland, Maier & Neustadt, L.L.P.

(57) ABSTRACT

A pressure booster having arranged therein drive cylinders on both sides of a boosting cylinder is provided with a pair of pilot valves that are actuated when pistons of the drive cylinders abut against the moving ends thereof. A pair of actuation valves switch the supply state of a pressure fluid to pressure chambers of the drive cylinders. When the pilot valves are actuated, the pressure fluid passes through the pilot valves and is supplied to the pair of actuation valves, and the supply state of the pressure fluid is switched.

14 Claims, 12 Drawing Sheets

(56) References Cited

FOREIGN PATENT DOCUMENTS

| | | | |
|---|---|---|---|
| JP | 2003-54836 | A | 2/2003 |
| WO | WO 2014/015903 | A1 | 1/2014 |

OTHER PUBLICATIONS

Taiwanese Office Action dated Apr. 11, 2019 in Patent Application No. 107117240.
Office Action dated Sep. 22, 2020 in corresponding Indian Patent Application No. 202047013654 (with English Translation), 6 pages.

* cited by examiner

PRESSURE BOOSTER

TECHNICAL FIELD

The present invention relates to a pressure booster for increasing the pressure of pressurized fluid and outputting the pressurized fluid.

BACKGROUND ART

Conventionally, there has been known a pressure booster that consecutively increases the pressure of pressurized fluid using reciprocating motion of a piston and then outputs the pressurized fluid.

For example, a pressure booster described in Japanese Laid-Open Patent Publication No. 08-021404 includes a pair of booster cylinders disposed to face each other and an energy collector cylinder disposed between the pair of booster cylinders. The booster cylinders and the energy collector cylinder include their respective pistons directly connected to a piston rod. In the pressure booster, compressed air is supplied to a compression chamber and a working chamber of one of the booster cylinders and to a compression chamber of the other booster cylinder, whereby the air supplied to the compression chamber of the one booster cylinder is boosted in pressure and then output. Switching operation of air-supply between the booster cylinders and of flow channels connected to the collector cylinder is performed by reed switches detecting the positions of the pistons in the booster cylinders to thereby turn on and off solenoids of a switching valve accordingly.

SUMMARY OF INVENTION

In the pressure booster described in Japanese Laid-Open Patent Publication No. 08-021404, the pair of booster cylinders are provided with the working chambers for driving the pistons and the compression chambers for compressing fluid. This may limit flexibility in design. In addition, since the reed switches and the solenoids are used to perform the switching operation, electrical means including electrical wiring is required.

The present invention has the object of providing a pressure booster including cylinders for driving pistons and for compressing pressurized fluid that are arranged separately in an organized manner, and which is capable of performing switching operations without electrical means.

A pressure booster according to the present invention, including a booster cylinder and drive cylinders disposed respectively on both sides of the booster cylinder, includes a pair of pilot valves each configured to be actuated when a piston of the corresponding drive cylinder is in abutment with the pilot valve at a moving end of the piston, and a pair of operating valves each configured to switch a state of supply of pressurized fluid from a pressurized fluid supply source, between pressure chambers of the drive cylinders, wherein when each of the pilot valves is actuated, the pressurized fluid is supplied to the pair of operating valves through the corresponding pilot valve to thereby switch the state of supply of the pressurized fluid.

Moreover, a pressure booster according to the present invention, including a booster cylinder and drive cylinders disposed respectively on both sides of the booster cylinder, includes a pair of pilot valves each configured to be actuated when a piston of the corresponding drive cylinder is in abutment with the pilot valve at a moving end of the piston, and a pair of operating valves each configured to switch a state of supply of pressurized fluid from a pressurized fluid supply source, between pressure chambers of the drive cylinders, wherein when each of the pilot valves is actuated, pressurized fluid from the booster cylinder is supplied to the pair of operating valves through the corresponding pilot valve to thereby switch the state of supply of the pressurized fluid.

According to the above-described pressure booster, it is possible to enhance flexibility in design. For example, it is possible to make the inner diameter of the cylinders for driving the pistons different from the inner diameter of the cylinder for compressing pressurized fluid. Moreover, since the pilot valves and the operating valves can be operated using mechanical means including fluid circuits, the need for electrical means including electrical wiring is eliminated.

In the above-described pressure booster, it is preferable that each of the operating valves switch between a state in which the pressurized fluid is supplied to the pressure chamber of the corresponding drive cylinder and pressurized fluid in a back pressure chamber of the corresponding drive cylinder is discharged, and a state in which part of the pressurized fluid in the pressure chamber of the corresponding drive cylinder is collected in the back pressure chamber of the corresponding drive cylinder. This makes it possible to reduce the consumption of pressurized fluid as much as possible.

In this case, it is preferable that each of the pilot valves include a push rod configured to protrude to an inside of the back pressure chamber of the corresponding drive cylinder by a biasing force of a spring and that the piston of the corresponding drive cylinder come into abutment with the push rod at the moving end. According to this, the pilot valves are actuated in a stable manner since the pilot valves are disposed in areas in which fluid pressure fluctuation is less likely to occur. In addition, when a silencer is provided in a channel through which the pressurized fluid in each of the back pressure chambers of the drive cylinders, it is possible to reduce exhaust noise generated at the operating valves and to prevent leakage, to the outside, of striking noise generated when the pistons of the drive cylinders come into abutment against the push rods of the pilot valves as much as possible.

Moreover, it is preferable that each of the push rods include a piston portion, that a space on a first side of the piston portion be exposed to an atmosphere while a space on a second side of the piston portion is connected to a pilot channel for switching the states of the pair of operating valves, and that the space on the first side and the space on the second side communicate with each other via a hole formed inside the push rod when the piston of each of the drive cylinders is not in abutment with the push rod. According to this, the pilot channel for switching the states of the operating valves can communicate with the atmosphere by using a simple structure.

Furthermore, each of the pilot valves may include a valve element with which the corresponding push rod is abuttable, and when the piston of each of the drive cylinders comes into abutment with the push rod and then brings the push rod into abutment with the valve element, the space on the second side may be connected to the pressurized fluid supply source or to a corresponding booster chamber of the booster cylinder and may be sealed from the hole formed inside the push rod. Moreover, each of the push rods may be slidably disposed inside a valve seat and a valve seat retainer, a first end face of the valve seat retainer may face the back pressure chamber of the corresponding drive cylinder while a second end face thereof is in abutment with the valve seat, and the space on the first side may include a groove formed on the second end face of the valve seat retainer.

In accordance with the pressure booster according to the present invention, flexibility in designing the cylinders for driving the pistons and the cylinder for compressing pressurized fluid can be increased, and the need for electrical means including electrical wiring for the pilot valves and the operating valves is eliminated.

DESCRIPTION OF EMBODIMENTS

Preferred embodiments of a pressure booster according to the present invention will be described in detail below with reference to the accompanying drawings.

First Embodiment

A pressure booster 10 according to a first embodiment of the present invention will now be described with reference to FIGS. 1 to 10. The pressure booster 10 is disposed between a pressurized fluid supply source (compressor; not illustrated) and an actuator (not illustrated) actuated by pressurized fluid whose pressure is boosted.

Figure 1:
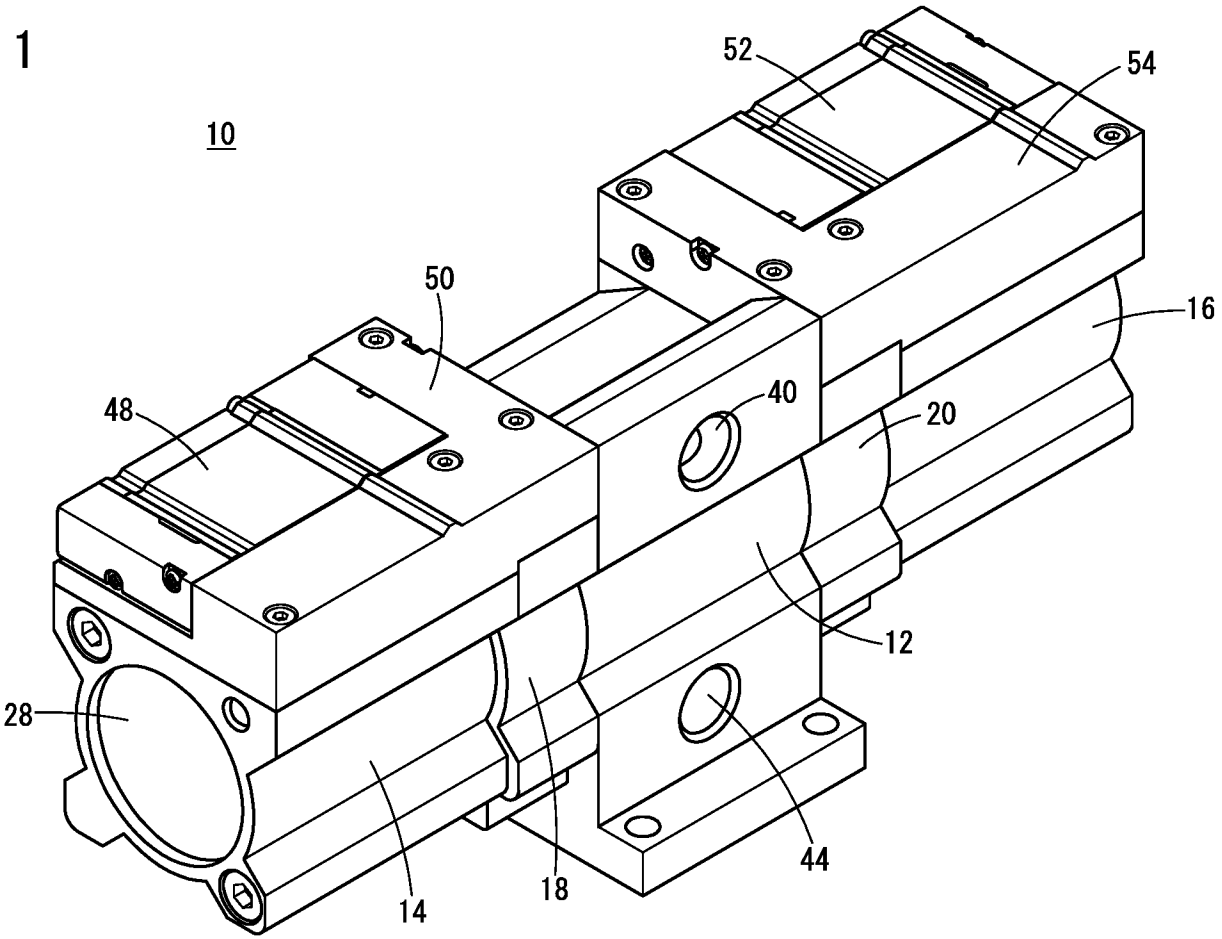
FIG. 1 is a schematic perspective view of a pressure booster according to a first embodiment of the present invention.
Figure 2:
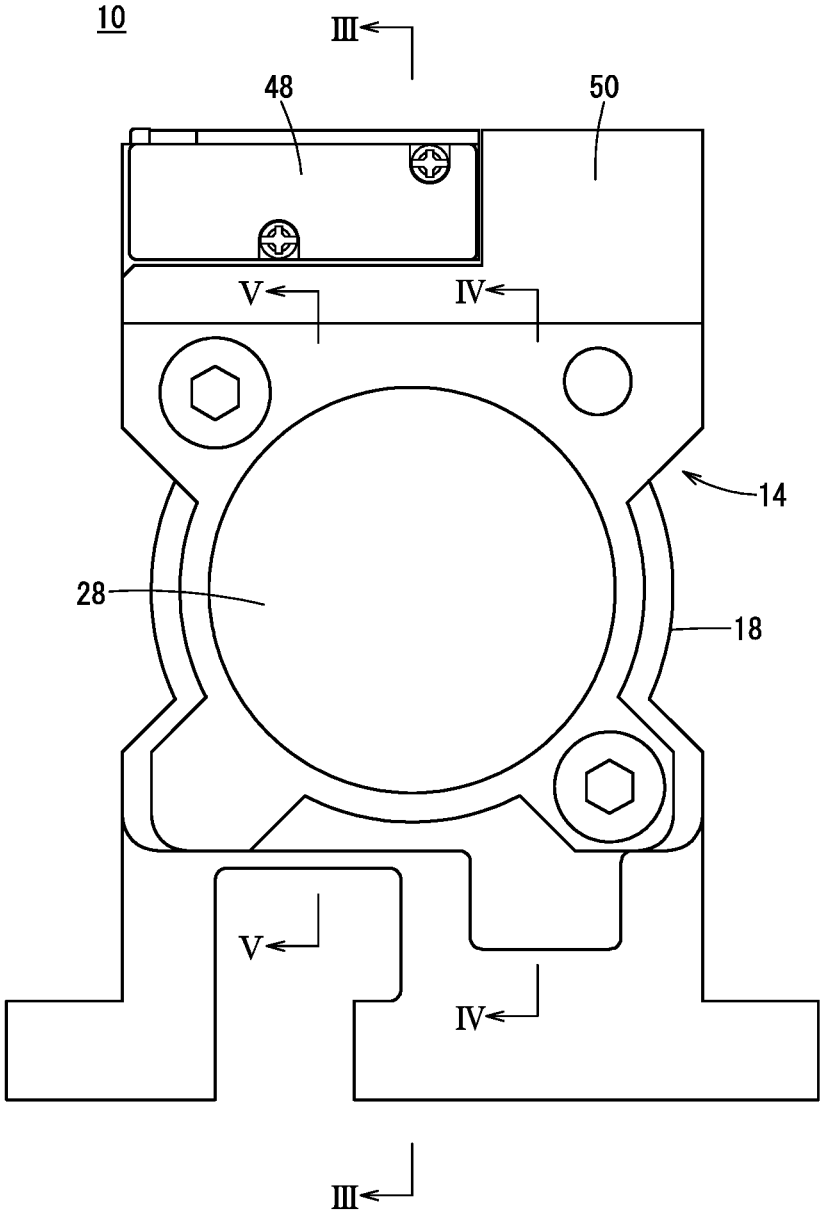
FIG. 2 is a side view of the pressure booster in FIG. 1.
Figure 3:
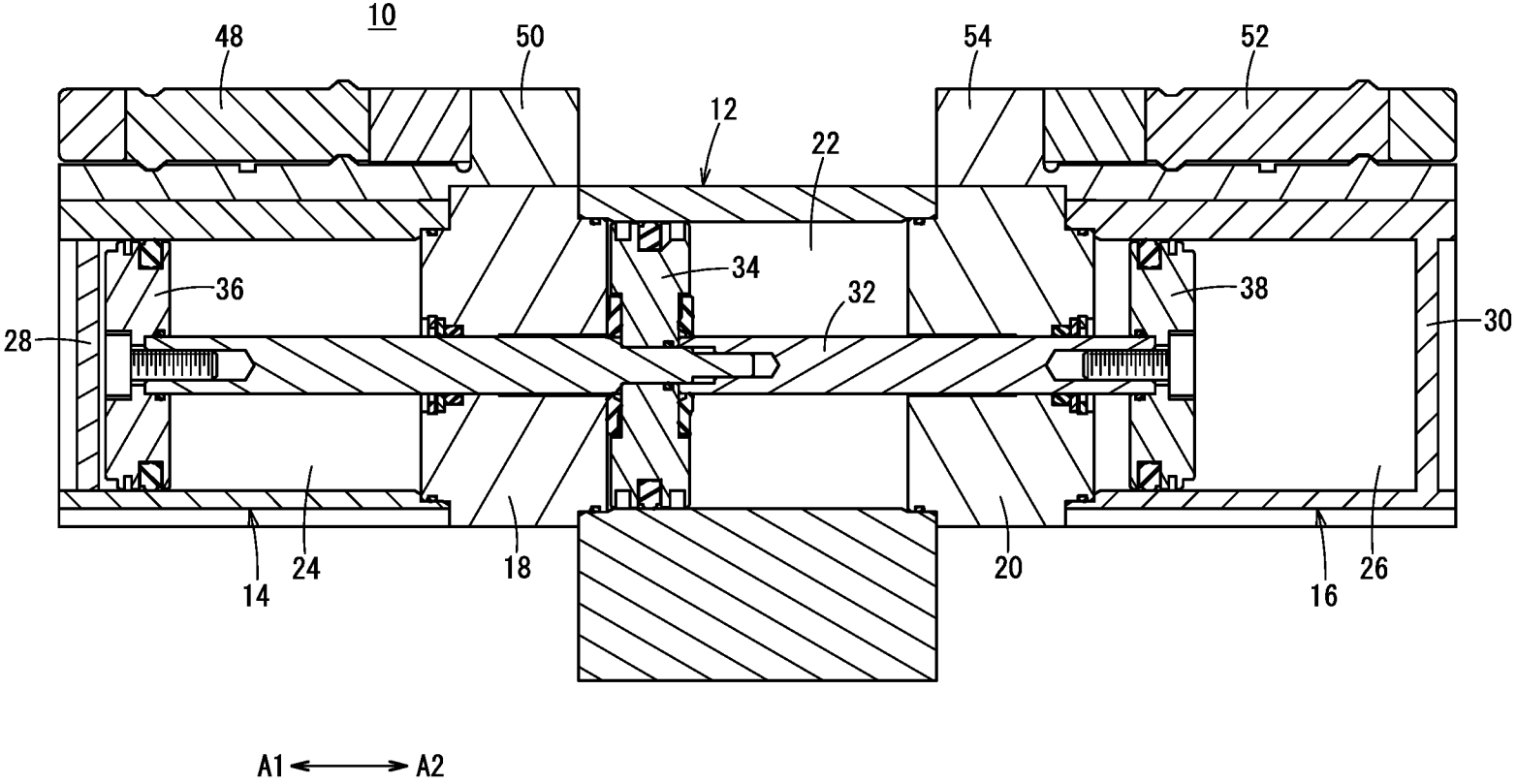
FIG. 3 is a cross-sectional view taken along line III-III in FIG. 2.

As illustrated in FIGS. 1 and 3, the pressure booster 10 has a triple cylinder structure including a booster cylinder 12, a first drive cylinder 14 disposed at a first end of the booster cylinder 12 (an end on an A1 direction side), and a second drive cylinder 16 disposed at a second end of the booster cylinder 12 (an end on an A2 direction side), which are connected in a row. That is, in the pressure booster 10, the first drive cylinder 14, the booster cylinder 12, and the second drive cylinder 16 are arranged in this order from the A1 direction to the A2 direction.

A first cover member 18 in the form of a block is interposed between the first drive cylinder 14 and the booster cylinder 12, and a second cover member 20 in the form of a block is interposed between the booster cylinder 12 and the second drive cylinder 16.

The booster cylinder 12 includes a booster chamber 22 formed thereinside. The first drive cylinder 14 and the second drive cylinder 16 respectively include a first drive chamber 24 and a second drive chamber 26 formed thereinside. In this case, the first drive chamber 24 is formed by securing a third cover member 28 to an end portion of the first drive cylinder 14 on the A1 direction side and arranging the first cover member 18 at another end portion on the A2 direction side. The second drive chamber 26 is formed by arranging the second cover member 20 at an end portion of the second drive cylinder 16 on the A1 direction side and closing another end portion on the A2 direction side with a wall portion 30.

As illustrated in FIG. 3, a piston rod 32 is arranged to pass through the first cover member 18, the booster cylinder 12, and the second cover member 20. The piston rod 32 includes two shaft members connected in series. A first end portion of the piston rod 32 extends into the first drive chamber 24, and a second end portion of the piston rod 32 extends into the second drive chamber 26.

In the booster chamber 22, a booster piston 34 is connected to the midsection of the piston rod 32. Thus, the booster chamber 22 is partitioned into a first booster chamber 22*a* on the A1 direction side and a second booster chamber 22*b* on the A2 direction side (see FIG. 6). In the first drive chamber 24, a first drive piston 36 is connected to the first end portion of the piston rod 32. Thus, the first drive chamber 24 is partitioned into a pressure chamber 24*a* on the A1 direction side and a back pressure chamber 24*b* on the A2 direction side (see FIG. 6). Moreover, in the second drive chamber 26, a second drive piston 38 is connected to the second end portion of the piston rod 32. Thus, the second drive chamber 26 is partitioned into a pressure chamber 26*a* on the A2 direction side and a back pressure chamber 26*b* on the A1 direction side (see FIG. 6). The booster piston 34, the first drive piston 36, and the second drive piston 38 are connected to each other in an integrated manner via the piston rod 32.

Figure 4:
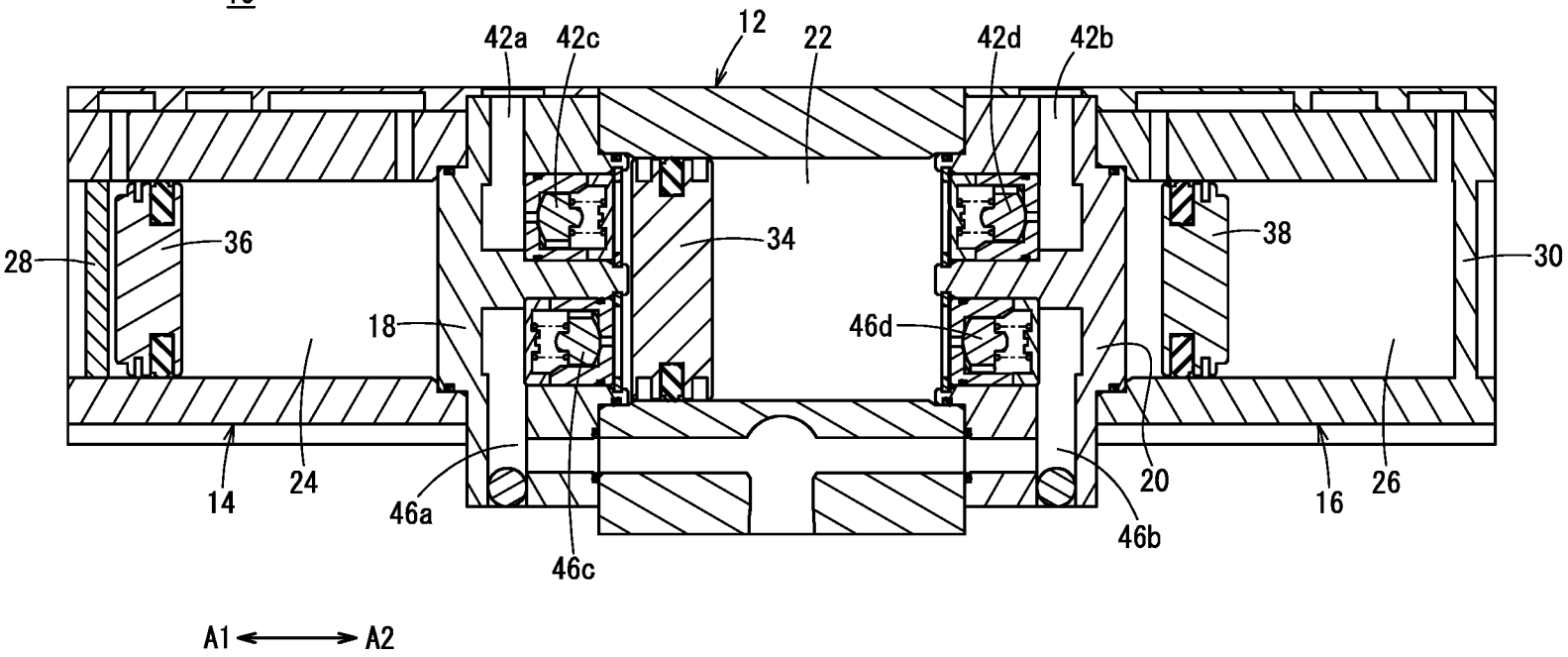
FIG. 4 is a cross-sectional view taken along line IV-IV in FIG. 2.
Figure 6:
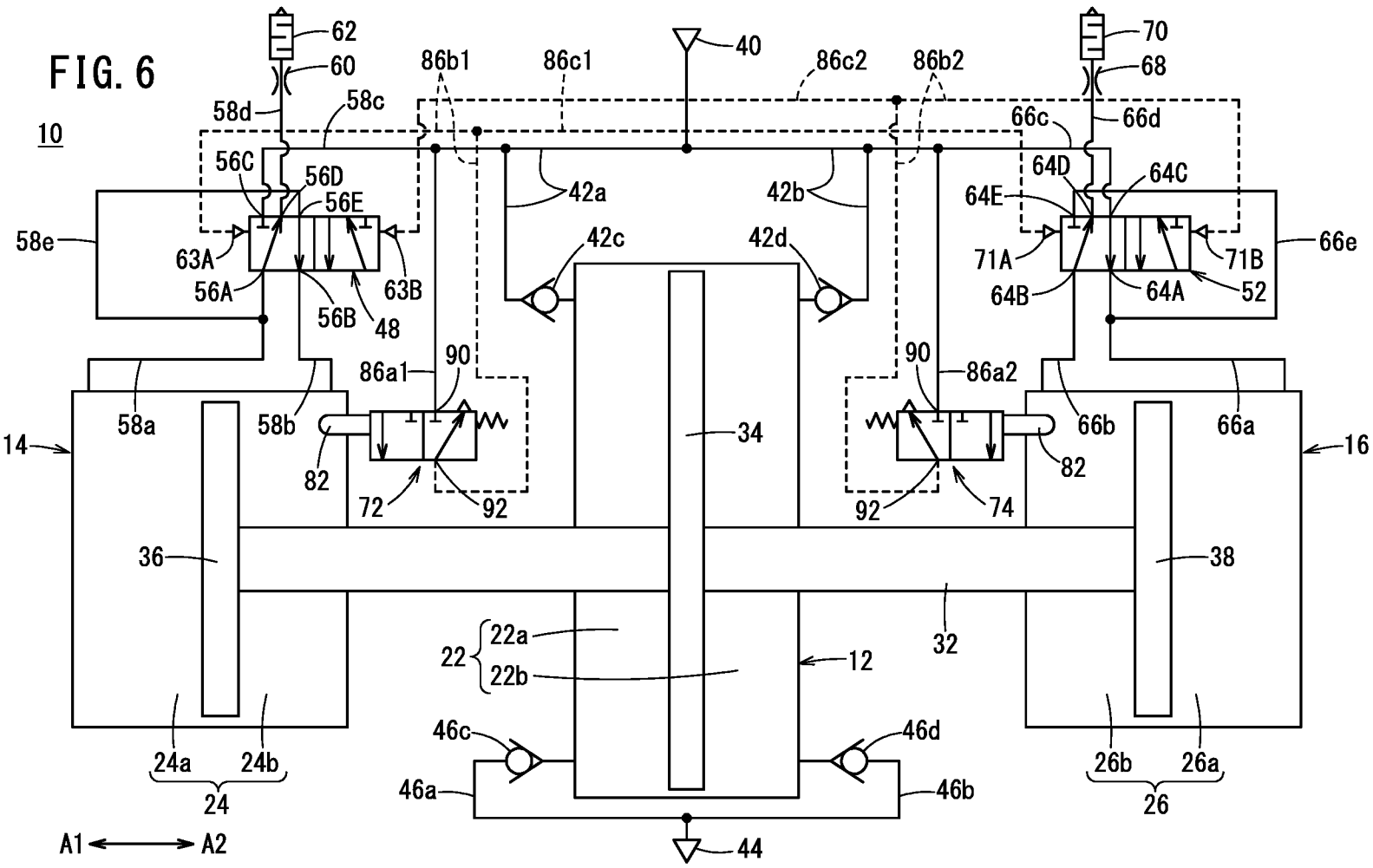
FIG. 6 is an overall schematic view of the pressure booster in FIG. 1 using a circuit diagram.

As illustrated in FIG. 1, a supply port 40, to which pressurized fluid is supplied from the pressurized fluid supply source (not illustrated), is formed in an upper portion of the front surface of the booster cylinder 12. As illustrated in FIGS. 4 and 6, a fluid supply mechanism is provided inside the booster cylinder 12, the first cover member 18, and the second cover member 20. The fluid supply mechanism communicates with the supply port 40 and delivers supplied pressurized fluid to the first booster chamber 22*a* and the second booster chamber 22*b*. The fluid supply mechanism includes a first supply channel 42*a* connecting the supply port 40 to the first booster chamber 22*a* and a second supply channel 42*b* connecting the supply port 40 to the second booster chamber 22*b*.

The first supply channel 42*a* is provided with a first supply check valve 42*c* that allows fluid to flow from the supply port 40 to the first booster chamber 22*a* but does not allow fluid to flow from the first booster chamber 22*a* to the supply port 40. The second supply channel 42*b* is provided with a second supply check valve 42*d* that allows fluid to flow from the supply port 40 to the second booster chamber 22*b* but does not allow fluid to flow from the second booster chamber 22*b* to the supply port 40.

As illustrated in FIG. 1, an output port 44 is formed in a lower portion of the front surface of the booster cylinder 12 to output fluid that has been boosted in pressure by pressure boost (described below), to the outside. As illustrated in FIGS. 4 and 6, a fluid output mechanism is provided inside the booster cylinder 12, the first cover member 18, and the second cover member 20. The fluid output mechanism communicates with the output port 44 and outputs fluid boosted in pressure in the first booster chamber 22*a* or the second booster chamber 22*b*, from the output port 44. The fluid output mechanism includes a first output channel 46*a* connecting the first booster chamber 22*a* to the output port 44 and a second output channel 46*b* connecting the second booster chamber 22*b* to the output port 44.

The first output channel 46*a* is provided with a first output check valve 46*c* that allows fluid to flow from the first booster chamber 22*a* to the output port 44 but does not allow fluid to flow from the output port 44 to the first booster chamber 22*a*. The second output channel 46*b* is provided with a second output check valve 46*d* that allows fluid to flow from the second booster chamber 22*b* to the output port 44 but does not allow fluid to flow from the output port 44 to the second booster chamber 22*b*.

Next, the configuration of operating valves will be described. As illustrated in FIG. 1, a first housing 50 including a first operating valve 48 is disposed on top of the first drive cylinder 14, and a second housing 54 including a second operating valve 52 is disposed on top of the second drive cylinder 16.

As illustrated in FIG. 6, the first operating valve 48 has a first port 56A to a fifth port 56E and is configured to switch between a first position where the first drive piston 36 is driven and a second position where the first drive piston 36 follows the movement of the second drive piston 38 as the second drive piston 38 is driven.

The first port 56A is connected to the pressure chamber 24*a* of the first drive cylinder 14 via a channel 58*a*. The second port 56B is connected to the back pressure chamber 24*b* of the first drive cylinder 14 via a channel 58*b*. The third port 56C is connected to the first supply channel 42*a* via a channel 58*c*. The fourth port 56D is connected to a first silencer 62 equipped with an exhaust port, via a channel 58*d*. The fifth port 56E is connected to a midway point of the channel 58*a* via a channel 58*e*. A first fixed orifice 60 is disposed on the channel 58*d*.

When the first operating valve 48 is in the first position, the first port 56A is connected to the third port 56C, and the second port 56B is connected to the fourth port 56D. As a result, pressurized fluid from the supply port 40 is supplied to the pressure chamber 24*a* through the channel 58*c* and the channel 58*a*, and fluid in the back pressure chamber 24*b* is discharged via the first fixed orifice 60 and the first silencer 62 through the channel 58*b* and the channel 58*d*. When the first operating valve 48 is in the second position, the first port 56A is connected to the fourth port 56D, and the second port 56B is connected to the fifth port 56E. As a result, part of the fluid in the pressure chamber 24*a* is collected in the back pressure chamber 24*b* through the channel 58*a*, the channel 58*e*, and the channel 58*b*, and the rest is discharged via the first fixed orifice 60 and the first silencer 62 through the channel 58*d*.

The first operating valve 48 has a first introduction port 63A through which pressurized fluid is introduced from a first pilot valve 72 (described below) and a second introduction port 63B through which pressurized fluid is introduced from a second pilot valve 74 (described below). The first operating valve 48 switches from the first position to the second position when pressurized fluid is supplied to the first introduction port 63A, and remains in the second position until pressurized fluid is supplied to the second introduction port 63B subsequently. The first operating valve 48 switches from the second position to the first position when pressurized fluid is supplied to the second introduction port 63B, and remains in the first position until pressurized fluid is supplied to the first introduction port 63A subsequently.

The second operating valve 52 has a first port 64A to a fifth port 64E and is configured to switch between a first position where the second drive piston 38 is driven and a second position where the second drive piston 38 follows the movement of the first drive piston 36 as the first drive piston 36 is driven.

The first port 64A is connected to the pressure chamber 26*a* of the second drive cylinder 16 via a channel 66*a*. The second port 64B is connected to the back pressure chamber 26*b* of the second drive cylinder 16 via a channel 66*b*. The third port 64C is connected to the second supply channel 42*b* via a channel 66*c*. The fourth port 64D is connected to a second silencer 70 equipped with an exhaust port, via a channel 66*d*. The fifth port 64E is connected to a midway point of the channel 66*a* via a channel 66*e*. A second fixed orifice 68 is disposed on the channel 66*d*.

When the second operating valve 52 is in the first position, the first port 64A is connected to the third port 64C, and the second port 64B is connected to the fourth port 64D. As a result, pressurized fluid from the supply port 40 is supplied to the pressure chamber 26*a* through the channel 66*c* and the channel 66*a*, and fluid in the back pressure chamber 26*b* is discharged via the second fixed orifice 68 and the second silencer 70 through the channel 66*b* and the channel 66*d*. When the second operating valve 52 is in the second position, the first port 64A is connected to the fourth port 64D, and the second port 64B is connected to the fifth port 64E. As a result, part of the fluid in the pressure chamber 26*a* is collected in the back pressure chamber 26*b* through the channel 66*a*, the channel 66*e*, and the channel 66*b*, and the rest is discharged via the second fixed orifice 68 and the second silencer 70 through the channel 66*d*.

The second operating valve 52 has a first introduction port 71A through which pressurized fluid is introduced from the first pilot valve 72 (described below) and a second introduction port 71B through which pressurized fluid is introduced from the second pilot valve 74 (described below). The second operating valve 52 switches from the second position to the first position when pressurized fluid is supplied to the first introduction port 71A, and remains in the first position until pressurized fluid is supplied to the second introduction port 71B subsequently. The second operating valve 52 switches from the first position to the second position when pressurized fluid is supplied to the second introduction port 71B, and remains in the second position until pressurized fluid is supplied to the first introduction port 71A subsequently.

Figure 5:
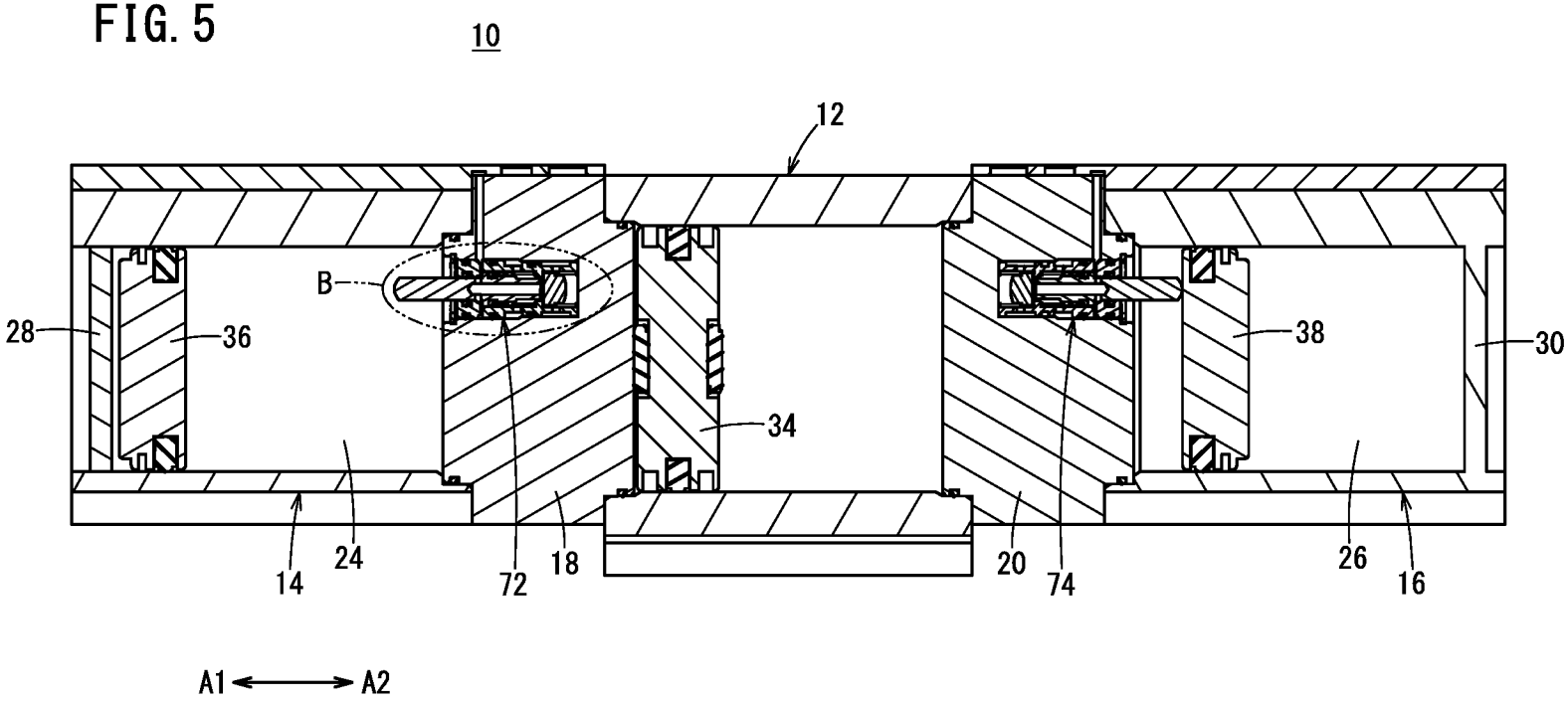
FIG. 5 is a cross-sectional view taken along line V-V in FIG. 2.

Next, the configuration of the pilot valves will be described. As illustrated in FIG. 5, the first pilot valve 72 is disposed inside the first cover member 18, and the second pilot valve 74 is disposed inside the second cover member 20. The first pilot valve 72 and the second pilot valve 74 have a common structure. Thus, the structure of the pilot valves will be described first in a collective manner with reference to FIG. 7.

The first pilot valve 72 and the second pilot valve 74 each include a valve seat 76, a valve seat retainer 78, a valve element 80, and a push rod 82. The first cover member 18 and the second cover member 20 each has a valve accommodating hole 84 which is closed on a side adjacent to the booster cylinder 12 and opened on the opposite side.

The valve seat 76 and the valve seat retainer 78, both having a cylindrical shape, are fitted into the valve accommodating hole 84. A first end face of the valve seat retainer 78 in the axial direction faces the back pressure chamber 24*b* of the first drive cylinder 14 or the back pressure chamber 26*b* of the second drive cylinder 16, and a second end face in the axial direction is in abutment against the valve seat 76. A snap ring 87 is secured to the opening of the valve accommodating hole 84 via a groove, and the snap ring 87 is in abutment against the valve seat retainer 78. Thus, the valve seat 76 and the valve seat retainer 78 are positioned and secured in the axial direction.

The inner circumference of the valve seat retainer 78 has an increased diameter on the second end side in the axial direction, whereby an annular recess 98 is formed. The valve seat retainer 78 has a plurality of grooves 100 extending radially, which are formed in the second end face in the axial direction. The grooves 100 communicate with the annular recess 98 on the inner circumference and communicate with the atmosphere on the outer circumference via paths (not illustrated). The inner diameter of the valve seat retainer 78 at the annular recess 98 is smaller than the inner diameter of a portion of the valve seat 76 that lies adjacent to the valve seat retainer 78. That is, the end face of the valve seat retainer 78 in abutment against the valve seat 76 protrudes inward more than the valve seat 76.

An annular flange portion 88 protruding inward is provided on the inner circumference of the valve seat 76. In addition, an annular protrusion 88*a* protruding toward the bottom of the valve accommodating hole 84 is formed on the end of the annular flange portion 88. A first annular recess 90 and a second annular recess 92 are formed in the outer circumference of the valve seat 76. The valve seat 76 has a plurality of first through-holes 94, extending from the bottom of the first annular recess 90 to the inner circumference of the valve seat 76, in a region closer to the bottom of the valve accommodating hole 84 than the annular flange portion 88 is. The valve seat 76 has a plurality of second through-holes 96, extending from the bottom of the second annular recess 92 to the inner circumference of the valve seat 76, in a region closer to the opening of the valve accommodating hole 84 than the annular flange portion 88 is.

The push rod 82 is slidably disposed inside the valve seat 76 and the valve seat retainer 78. The push rod 82 includes a head portion 82*a* at a first end thereof in the axial direction and a piston portion 82*b* in the middle in the axial direction. The head portion 82*a* is in sliding contact with the inner circumferential surface of the valve seat retainer 78, and the piston portion 82*b* is in sliding contact with the inner circumferential surface of the valve seat 76. The push rod 82 includes a reduced-diameter portion 82*d* formed at a second end in the axial direction via a stepped portion 82*c*. The end of the reduced-diameter portion 82*d* can be brought into abutment against the valve element 80. A central hole 82*e* and a plurality of radially-extending holes 82*f* are formed inside the push rod 82. The central hole 82*e* passes through the reduced-diameter portion 82*d* in the axial direction and further extends in the axial direction to reach the head portion 82*a*. The radially-extending holes 82*f* are orthogonal to the central hole 82*e* and are opened in the outer circumferential surface of the head portion 82*a*.

A first spring 102 is provided between the annular flange portion 88 of the valve seat 76 and the piston portion 82*b* of the push rod 82. The push rod 82 is biased in a direction away from the booster cylinder 12 by the biasing force of the first spring 102, and part of the head portion 82*a* protrudes to the inside of the back pressure chamber 24*b* of the first drive cylinder 14 or to the inside of the back pressure chamber 26*b* of the second drive cylinder 16. The end face of the piston portion 82*b* comes into abutment with the end face of the valve seat retainer 78 to thereby restrict the movement of the push rod 82 in the direction away from the booster cylinder 12.

The cylindrical valve element 80 is disposed inside the valve seat 76 in a position closer to the bottom of the valve accommodating hole 84 than the annular flange portion 88 is. A second spring 104 is provided between the bottom of the valve accommodating hole 84 and the valve element 80. The valve element 80 is biased toward the annular flange portion 88 of the valve seat 76 by the biasing force of the second spring 104.

A first seal member 110*a* and a second seal member 110*b* are provided on the outer circumference of the valve seat 76 via grooves. The first seal member 110*a* and the second seal member 110*b* are in pressure contact with the inner wall of the valve accommodating hole 84. A third seal member 110*c* is provided on the outer circumference of the valve seat retainer 78 via a groove. The third seal member 110*c* is in pressure contact with the inner wall of the valve accommodating hole 84. A fourth seal member 110*d* is provided on the inner circumference of the valve seat retainer 78 via a groove. The fourth seal member 110*d* is in sliding contact with the outer circumferential surface of the head portion 82*a* of the push rod 82. A fifth seal member 110*e* is provided on the piston portion 82*b* of the push rod 82 via a groove. The fifth seal member 110*e* is in sliding contact with the inner circumferential surface of the valve seat 76.

The first pilot valve 72 and the second pilot valve 74 are configured as above. Next, the first pilot valve 72 and the second pilot valve 74 will be described with reference to FIGS. 6 to 8, in relation to the surrounding channels.

A channel 86*a*1 is formed inside the first cover member 18. A first end of the channel 86*a*1 communicates with the first annular recess 90 of the valve seat 76 in the first pilot valve 72, and a second end thereof is connected to the first supply channel 42*a*. A pilot channel 86*b*1 is formed inside the first cover member 18 and the first housing 50. A first end of the pilot channel 86*b*1 communicates with the second annular recess 92 of the valve seat 76 in the first pilot valve 72, and a second end thereof extends to the first introduction port 63A of the first operating valve 48. A pilot channel 86*c*1 is formed inside the first cover member 18, the booster cylinder 12, and the second housing 54. The pilot channel 86*c*1 branches off from the pilot channel 86*b*1 and extends to the first introduction port 71A of the second operating valve 52.

Figure 7:
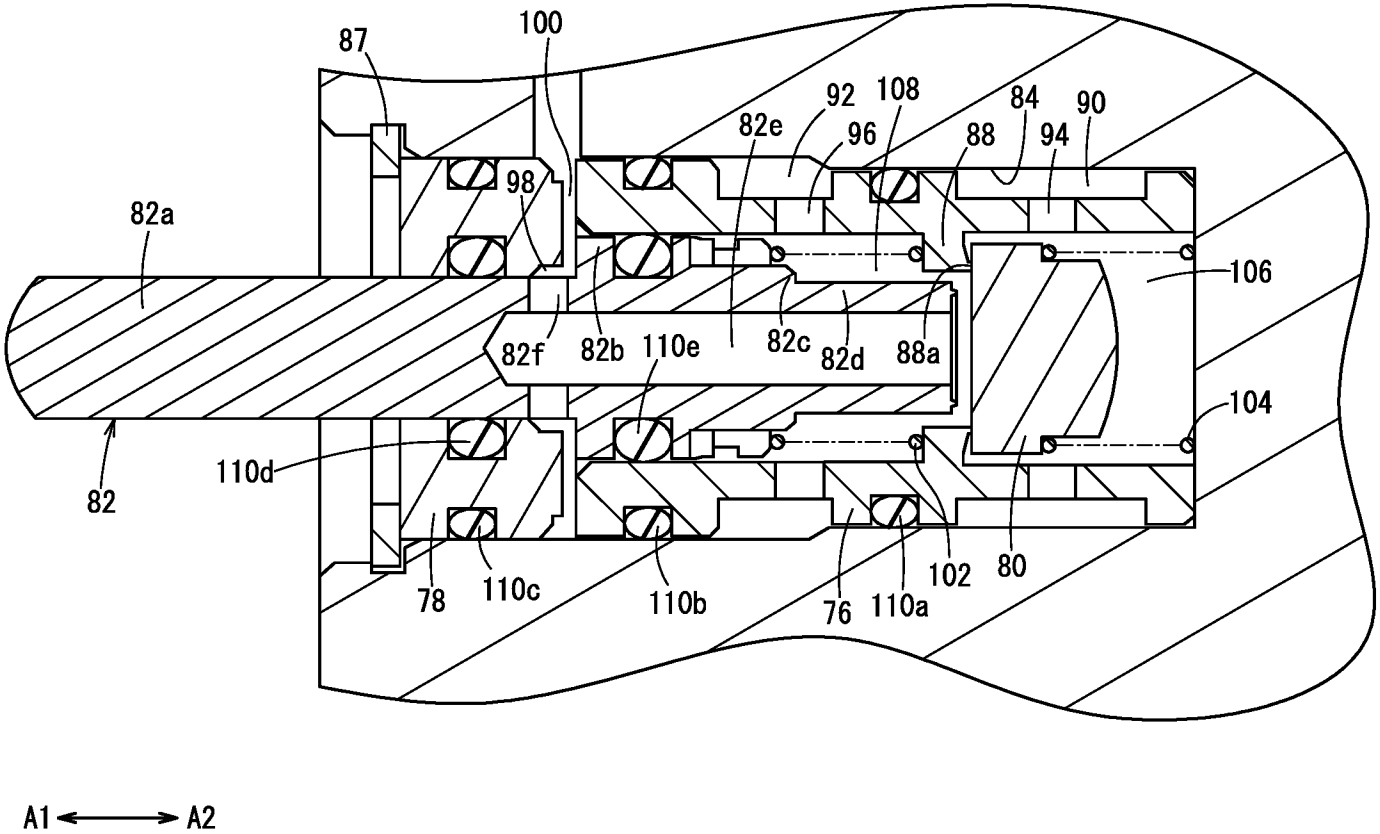
FIG. 7 is an enlarged view of part B in FIG. 5.

As illustrated in FIG. 7, in the first pilot valve 72, the space inside the valve seat 76 is hermetically partitioned into a first area 106 communicating with the first through-holes 94 and a second area 108 communicating with the second through-holes 96 when the reduced-diameter portion 82*d* of the push rod 82 is not in abutment with the valve element 80, i.e., when the valve element 80 is in pressure contact with the annular protrusion 88*a* of the annular flange portion 88 by the biasing force of the second spring 104. In addition, the second area 108 communicates with the central hole 82*e* of the push rod 82. The second area 108 communicates with the pilot channel 86*b*1 via the second through-holes 96 and the second annular recess 92 of the valve seat 76, and the central hole 82*e* of the push rod 82 is exposed to the atmosphere via the radially-extending holes 82*f* and the annular recess 98 and the grooves 100 of the valve seat retainer 78. Consequently, the pilot channel 86*b*1 is exposed to the atmosphere under normal conditions.

Figure 8:
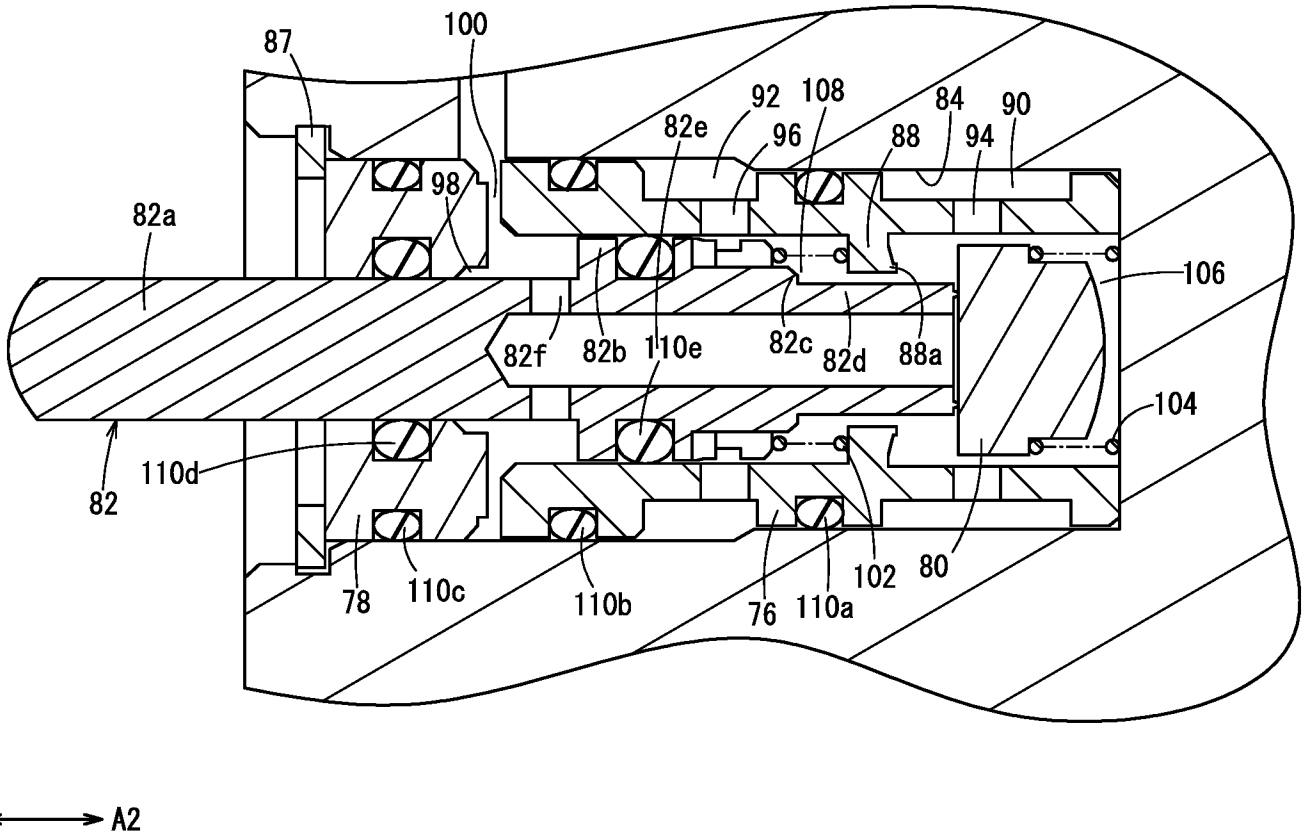
FIG. 8 is an enlarged view of the part B in FIG. 5 when a pilot valve is actuated.

On the other hand, as illustrated in FIG. 8, in the first pilot valve 72, the first through-holes 94 and the second through-holes 96 of the valve seat 76 communicate with each other via the space inside the valve seat 76 in a state that the valve element 80 is pushed by the end of the reduced-diameter portion 82*d* of the push rod 82 to be separated from the annular protrusion 88*a* of the annular flange portion 88 (i.e., in a state that the pilot valve is actuated). In addition, when the reduced-diameter portion 82*d* of the push rod 82 is in pressure contact with the end face of the valve element 80, the central hole 82*e* of the push rod 82 is sealed from the space inside the valve seat 76. Thus, the pilot channel 86*b*1 communicating with the second through-holes 96 via the second annular recess 92 is connected to the channel 86*a*1 communicating with the first through-holes 94 via the first annular recess 90. Consequently, in the above-described state, the pilot channel 86*b*1 is connected to the supply port 40 via the channel 86*a*1.

A channel 86*a*2 is formed inside the second cover member 20. A first end of the channel 86*a*2 communicates with the first annular recess 90 of the valve seat 76 in the second pilot valve 74, and a second end thereof is connected to the second supply channel 42*b*. A pilot channel 86*b*2 is formed inside the second cover member 20 and the second housing 54. A first end of the pilot channel 86*b*2 communicates with the second annular recess 92 of the valve seat 76 in the second pilot valve 74, and a second end thereof extends to the second introduction port 71B of the second operating valve 52. A pilot channel 86*c*2 is formed inside the second cover member 20, the booster cylinder 12, and the first housing 50. The pilot channel 86*c*2 branches off from the pilot channel 86*b*2 and extends to the second introduction port 63B of the first operating valve 48.

As illustrated in FIG. 7, in the second pilot valve 74, the space inside the valve seat 76 is hermetically partitioned into the first area 106 communicating with the first through-holes 94 and the second area 108 communicating with the second through-holes 96 when the valve element 80 is in pressure contact with the annular protrusion 88*a* of the annular flange portion 88 by the biasing force of the second spring 104 as the reduced-diameter portion 82*d* of the push rod 82 is not in abutment with the valve element 80. In addition, the second area 108 communicates with the central hole 82*e* of the push rod 82. The second area 108 communicates with the pilot channel 86*b*2 via the second through-holes 96 and the second annular recess 92 of the valve seat 76, and the central hole 82*e* of the push rod 82 is exposed to the atmosphere via the radially-extending holes 82*f* and the annular recess 98 and the grooves 100 of the valve seat retainer 78. Consequently, the pilot channel 86*b*2 is exposed to the atmosphere under normal conditions.

On the other hand, as illustrated in FIG. 8, in the second pilot valve 74, the first through-holes 94 and the second through-holes 96 of the valve seat 76 communicate with each other via the space inside the valve seat 76 in a state that the valve element 80 is pushed by the end of the reduced-diameter portion 82*d* of the push rod 82 to be separated from the annular protrusion 88*a* of the annular flange portion 88 (i.e., in a state that the pilot valve is actuated). In addition, when the reduced-diameter portion 82*d* of the push rod 82 is in pressure contact with the end face of the valve element 80, the central hole 82*e* of the push rod 82 is sealed from the space inside the valve seat 76. Thus, the pilot channel 86*b*2 communicating with the second through-holes 96 via the second annular recess 92 is connected to the channel 86*a*2 communicating with the first through-holes 94 via the first annular recess 90. Consequently, in the above-described state, the pilot channel 86*b*2 is connected to the supply port 40 via the channel 86*a*2.

The pressure booster 10 according to the first embodiment is basically configured as above. Next, the operations and operational effects thereof will be described. A state in which the first operating valve 48 is switched to the second position, the second operating valve 52 is switched to the first position, and the booster piston 34 is located adjacent to the middle of the booster chamber 22 as illustrated in FIG. 6 is defined as an initial position.

In the initial position, when pressurized fluid is supplied from the pressurized fluid supply source to the supply port 40, the pressurized fluid flows into the first supply channel 42*a* and the second supply channel 42*b*. The pressurized fluid is then introduced to the first booster chamber 22*a* and the second booster chamber 22*b* of the booster cylinder 12 via the first supply check valve 42*c* and the second supply check valve 42*d*, respectively.

Part of the pressurized fluid supplied from the supply port 40 is supplied to the pressure chamber 26*a* of the second drive cylinder 16 through the channel 66*c*, the second operating valve 52 in the first position, and the channel 66*a*. The pressurized fluid supplied to the pressure chamber 26*a* drives the second drive piston 38 in the A1 direction. This causes the booster piston 34 connected to the second drive piston 38 in an integrated manner to slide, resulting in an increase in the pressure of the pressurized fluid in the first booster chamber 22*a* of the booster cylinder 12. The boosted pressurized fluid is guided to and output from the output port 44 through the first output channel 46*a* and the first output check valve 46*c*.

On the other hand, when the first drive piston 36 connected to the second drive piston 38 in an integrated manner slides, the volume of the pressure chamber 24*a* of the first drive cylinder 14 decreases. Since the first operating valve 48 is in the second position, part of the pressurized fluid in the pressure chamber 24*a* is collected in the back pressure chamber 24*b* through the channel 58*a*, the channel 58*e*, and the channel 58*b*, and the rest is discharged through the channel 58*d*.

Figure 9:
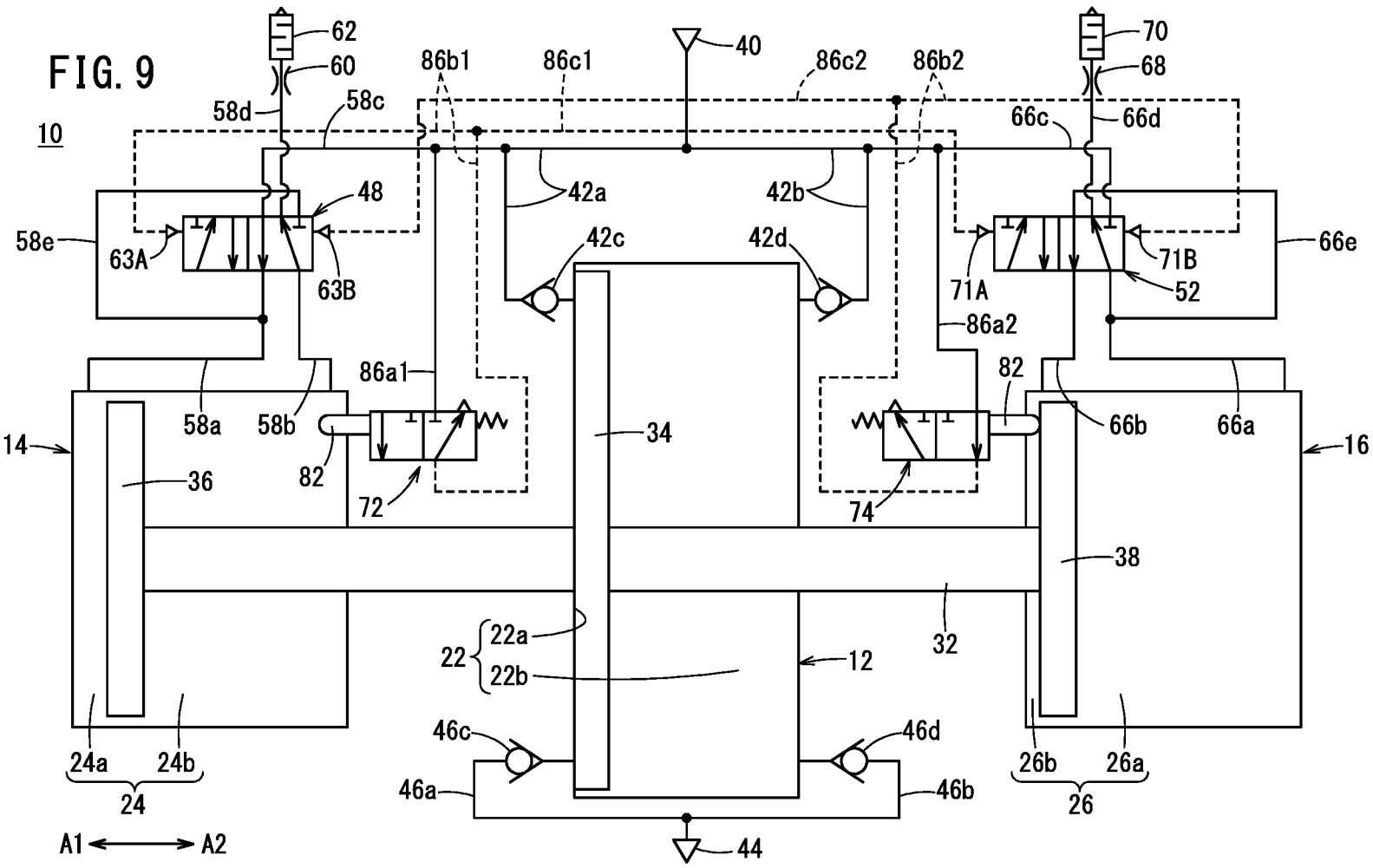
FIG. 9 is a view, corresponding to FIG. 6, illustrating a state of the pressure booster after transition from the state illustrated in FIG. 6 to another state.

As illustrated in FIG. 9, when the booster piston 34 is further displaced in the A1 direction to reach an end position, the second drive piston 38 comes into abutment with the head portion 82*a* of the push rod 82 in the second pilot valve 74 and causes the push rod 82 to be displaced. As a result, pressurized fluid supplied from the supply port 40 is supplied to the second introduction port 71B of the second operating valve 52 through the channel 86*a*2, the second pilot valve 74, and the pilot channel 86*b*2, and to the second introduction port 63B of the first operating valve 48 through the pilot channel 86*c*2. At this time, since the pilot channel 86*b*1 of the first pilot valve 72 is exposed to the atmosphere, the pressurized fluid supplied to the first introduction port 71A of the second operating valve 52 is discharged to the atmosphere through the pilot channel 86*c*1 and the pilot channel 86*b*1, and the pressurized fluid supplied to the first introduction port 63A of the first operating valve 48 is discharged to the atmosphere through the pilot channel 86*b*1. Consequently, the first operating valve 48 is switched to the first position, and the second operating valve 52 is switched to the second position.

Figure 10:
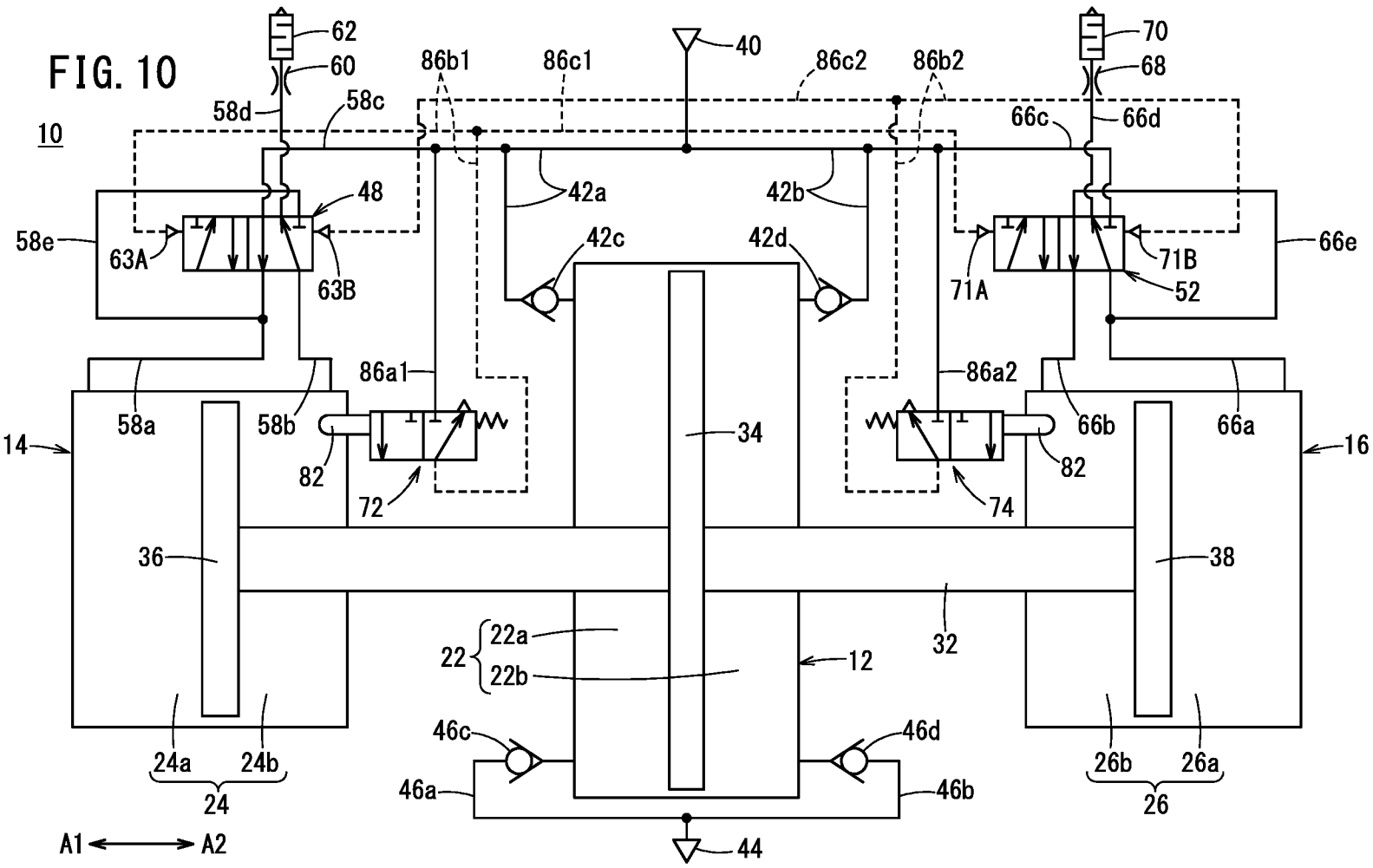
FIG. 10 is a view, corresponding to FIG. 6, illustrating another state of the pressure booster after transition from the state illustrated in FIG. 9 to still another state.

Then, part of the pressurized fluid supplied from the supply port 40 is supplied to the pressure chamber 24*a* of the first drive cylinder 14 through the channel 58*c*, the first operating valve 48 in the first position, and the channel 58*a*. As illustrated in FIG. 10, the pressurized fluid supplied to the pressure chamber 24*a* drives the first drive piston 36 in the A2 direction. This causes the booster piston 34 connected to the first drive piston 36 in an integrated manner to slide, resulting in an increase in the pressure of the pressurized fluid in the second booster chamber 22*b* of the booster cylinder 12. The boosted pressurized fluid is guided to and output from the output port 44 through the second output channel 46*b* and the second output check valve 46*d*.

On the other hand, when the second drive piston 38 connected to the first drive piston 36 in an integrated manner slides, the volume of the pressure chamber 26*a* of the second drive cylinder 16 decreases. Since the second operating valve 52 is in the second position, part of the pressurized fluid in the pressure chamber 26*a* is collected in the back pressure chamber 26*b* through the channel 66*a*, the channel 66*e*, and the channel 66*b*, and the rest is discharged through the channel 66*d*.

When the piston rod 32 is further displaced in the A2 direction to reach an end position, the first drive piston 36 comes into abutment with the head portion 82*a* of the push rod 82 in the first pilot valve 72 and causes the push rod 82 to be displaced (not illustrated). As a result, pressurized fluid supplied from the supply port 40 is supplied to the first introduction port 63A of the first operating valve 48 through the channel 86*a*1, the first pilot valve 72, and the pilot channel 86*b*1, and to the first introduction port 71A of the second operating valve 52 through the pilot channel 86*c*1. At this time, since the pilot channel 86*b*2 of the second pilot valve 74 is exposed to the atmosphere, the pressurized fluid supplied to the second introduction port 63B of the first operating valve 48 is discharged to the atmosphere through the pilot channel 86*c*2 and the pilot channel 86*b*2, and the pressurized fluid supplied to the second introduction port 71B of the second operating valve 52 is discharged to the atmosphere through the pilot channel 86*b*2. Consequently, the first operating valve 48 is switched to the second position, and the second operating valve 52 is switched to the first position. The booster piston 34 repeats the reciprocating motion in the above manner to consecutively output boosted pressurized fluid from the output port 44.

The pressure booster 10 according to this embodiment performs switching of the first operating valve 48 and the second operating valve 52 and actuation of the first pilot valve 72 and the second pilot valve 74 using mechanical means including fluid circuits without the need for electrical means.

Moreover, part of the pressurized fluid that has been supplied to the pressure chamber 24*a* to drive the first drive piston 36 is collected in the back pressure chamber 24*b* when the first drive piston 36 is driven by the movement of the second drive piston 38 as the second drive piston 38 is driven. This makes it possible to reduce the consumption of pressurized fluid. Similarly, part of the pressurized fluid that has been supplied to the pressure chamber 26*a* to drive the second drive piston 38 is collected in the back pressure chamber 26*b* when the second drive piston 38 is driven by the movement of the first drive piston 36 as the first drive piston 36 is driven. This also makes it possible to reduce the consumption of pressurized fluid.

Furthermore, the push rods 82 face the back pressure chamber 24*b* of the first drive cylinder 14 and the back pressure chamber 26*b* of the second drive cylinder 16 respectively. Since fluid pressure fluctuation is less likely to occur in the back pressure chambers, the first pilot valve 72 and the second pilot valve 74 can be operated stably. Alternatively, the first pilot valve 72 and the second pilot valve 74 may be disposed to face respectively the second booster chamber 22*b* and the first booster chamber 22*a* of the booster cylinder 12. In this case, care must be given so that an increase in the fluid pressure in the first booster chamber 22*a* or the second booster chamber 22*b* may adversely affect the operation of the push rods 82.

Yet moreover, the first silencer 62 is provided in the channel 58*d* through which pressurized fluid in the back pressure chamber 24*b* of the first drive cylinder 14 is discharged. This reduces exhaust noise generated at the first operating valve 48 and prevents leakage of striking noise generated when the first drive piston 36 comes into abutment against the push rod 82 of the first pilot valve 72, to the outside. Similarly, the second silencer 70 is provided in the channel 66*d* discharging pressurized fluid in the back pressure chamber 26*b* of the second drive cylinder 16. This reduces exhaust noise generated at the second operating valve 52 and prevents leakage of striking noise generated when the second drive piston 38 comes into abutment against the push rod 82 of the second pilot valve 74, to the outside.

Second Embodiment

Figure 11:
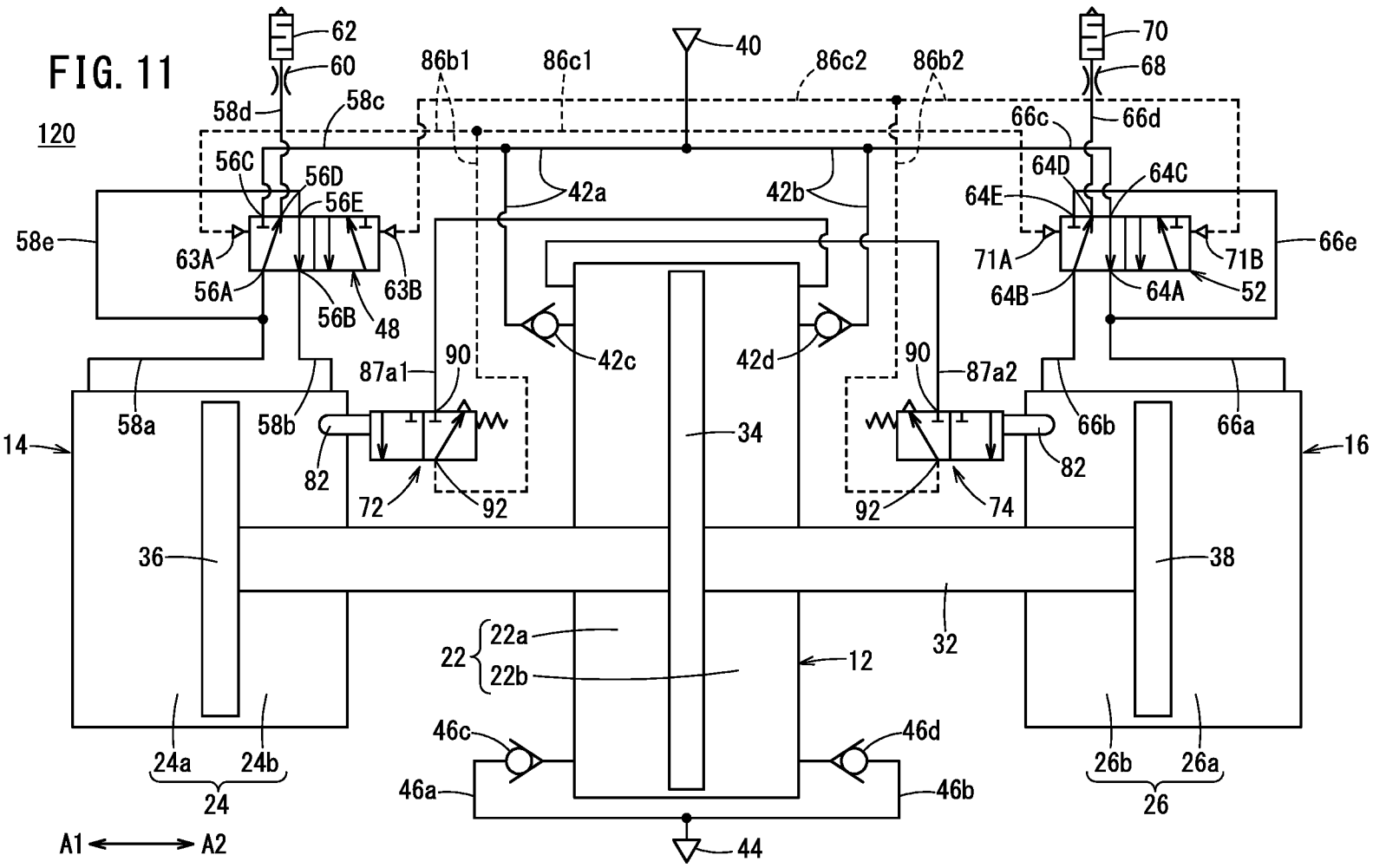
FIG. 11 is an overall schematic view of a pressure booster according to a second embodiment of the present invention using a circuit diagram.

Next, a pressure booster 120 according to a second embodiment of the present invention will be described with reference to FIGS. 11 and 12. The second embodiment differs from the first embodiment in the sources and paths of pressurized fluid supplied to the first annular recesses 90 of the pilot valves. In the pressure booster 120 according to the second embodiment, the same reference numerals and symbols are used for components identical to those in the pressure booster 10 described above, and the detailed descriptions will be omitted.

A channel 87*a*1 is formed inside the first cover member 18 and the booster cylinder 12. A first end of the channel 87*a*1 communicates with the first annular recess 90 of the valve seat 76 in the first pilot valve 72, and a second end thereof is connected to the second booster chamber 22*b*. The pilot channel 86*b*1 is formed inside the first cover member 18 and the first housing 50. The first end of the pilot channel 86*b*1 communicates with the second annular recess 92 of the valve seat 76 in the first pilot valve 72, and the second end extends to the first introduction port 63A of the first operating valve 48. The pilot channel 86*c*1 is formed inside the first cover member 18, the booster cylinder 12, and the second housing 54. The pilot channel 86*c*1 branches off from the pilot channel 86*b*1 and extends to the first introduction port 71A of the second operating valve 52.

While the first pilot valve 72 is not actuated (see FIG. 7), the pilot channel 86*b*1 is exposed to the atmosphere. On the other hand, while the first pilot valve 72 is actuated (see FIG. 8), the pilot channel 86*b*1 is connected to the second booster chamber 22*b* via the channel 87*a*1.

A channel 87*a*2 is formed inside the second cover member 20 and the booster cylinder 12. A first end of the channel 87*a*2 communicates with the first annular recess 90 of the valve seat 76 in the second pilot valve 74, and a second end thereof is connected to the first booster chamber 22*a*. The pilot channel 86*b*2 is formed inside the second cover member 20 and the second housing 54. The first end of the pilot channel 86*b*2 communicates with the second annular recess 92 of the valve seat 76 in the second pilot valve 74, and the second end extends to the second introduction port 71B of the second operating valve 52. The pilot channel 86*c*2 is formed inside the second cover member 20, the booster cylinder 12, and the first housing 50. The pilot channel 86*c*2 branches off from the pilot channel 86*b*2 and extends to the second introduction port 63B of the first operating valve 48.

While the second pilot valve 74 is not actuated (see FIG. 7), the pilot channel 86*b*2 is exposed to the atmosphere. On the other hand, while the second pilot valve 74 is actuated (see FIG. 8), the pilot channel 86*b*2 is connected to the first booster chamber 22*a* via the channel 87*a*2.

Next, the operation of the pressure booster 120 according to the second embodiment will be described, focusing on the operation of the first pilot valve 72 and the second pilot valve 74. A state in which the first operating valve 48 is switched to the second position, the second operating valve 52 is switched to the first position, and the booster piston 34 is located adjacent to the middle of the booster chamber 22 as illustrated in FIG. 11 is defined as an initial position.

In the initial position, when pressurized fluid is supplied from the pressurized fluid supply source to the supply port 40, the pressurized fluid is supplied to the pressure chamber 26*a* of the second drive cylinder 16, and the second drive piston 38 is driven in the A1 direction. This causes the booster piston 34 connected to the second drive piston 38 in an integrated manner to slide, resulting in an increase in the pressure of the pressurized fluid in the first booster chamber 22*a* of the booster cylinder 12. The boosted pressurized fluid in the first booster chamber 22*a* is guided to and output from the output port 44. On the other hand, part of the fluid in the pressure chamber 24*a* of the first drive cylinder 14 is collected in the back pressure chamber 24*b*, and the rest is discharged. The boosted pressurized fluid in the first booster chamber 22*a* is also introduced to the first annular recess 90 of the second pilot valve 74. Since the second pilot valve 74 is not actuated at this moment, the pressurized fluid introduced to the first annular recess 90 remains as it is.

Figure 12:
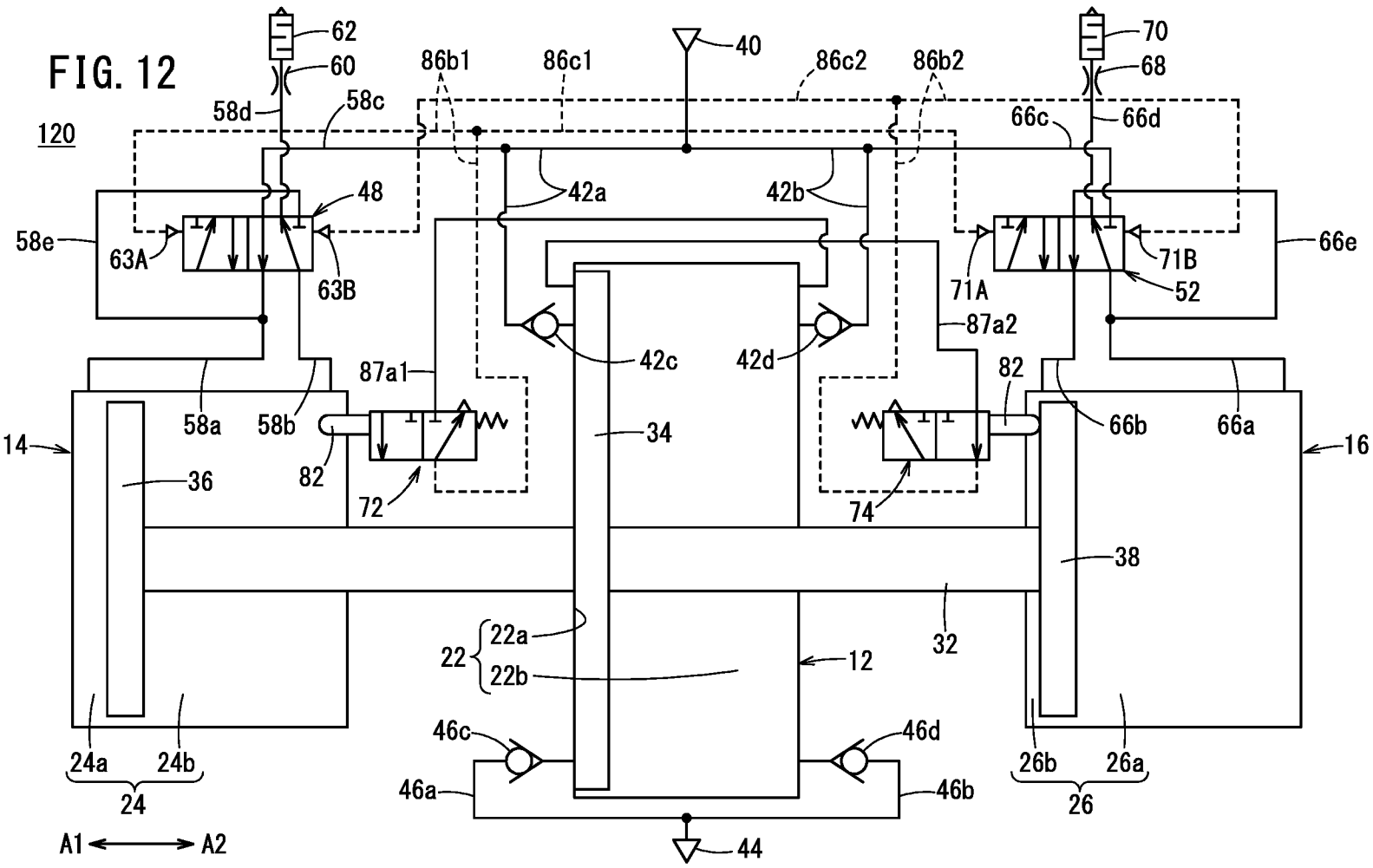
FIG. 12 is a view, corresponding to FIG. 11, illustrating a state of the pressure booster after transition from the state illustrated in FIG. 11 to another state.

As illustrated in FIG. 12, when the booster piston 34 is further displaced in the A1 direction to reach the end position, the second drive piston 38 comes into abutment with the head portion 82*a* of the push rod 82 in the second pilot valve 74 and causes the push rod 82 to be displaced. As a result, the boosted pressurized fluid in the first booster chamber 22*a* is supplied to the second introduction port 71B of the second operating valve 52 through the channel 87*a*2, the second pilot valve 74, and the pilot channel 86*b*2, and to the second introduction port 63B of the first operating valve 48 through the pilot channel 86*c*2. Consequently, the first operating valve 48 is switched to the first position, and the second operating valve 52 is switched to the second position.

Then, pressurized fluid supplied from the supply port 40 is supplied to the pressure chamber 24*a* of the first drive cylinder 14, and the first drive piston 36 is driven in the A2 direction. This causes the booster piston 34 connected to the first drive piston 36 in an integrated manner to slide, resulting in an increase in the pressure of the pressurized fluid in the second booster chamber 22*b* of the booster cylinder 12. The boosted pressurized fluid is guided to and output from the output port 44. On the other hand, part of the fluid in the pressure chamber 26*a* of the second drive cylinder 16 is collected in the back pressure chamber 26*b*, and the rest is discharged. The boosted pressurized fluid in the second booster chamber 22*b* is also introduced to the first annular recess 90 of the first pilot valve 72. Since the first pilot valve 72 is not actuated at this moment, the pressurized fluid introduced to the first annular recess 90 remains as it is.

When the piston rod 32 is further displaced in the A2 direction to reach the end position, the first drive piston 36 comes into abutment with the head portion 82*a* of the push rod 82 in the first pilot valve 72 and causes the push rod 82 to be displaced (not illustrated). As a result, the boosted pressurized fluid in the second booster chamber 22*b* is supplied to the first introduction port 63A of the first operating valve 48 through the channel 87*a*1, the first pilot valve 72, and the pilot channel 86*b*1, and to the first introduction port 71A of the second operating valve 52 through the pilot channel 86*c*1. Consequently, the first operating valve 48 is switched to the second position, and the second operating valve 52 is switched to the first position. The booster piston 34 repeats the reciprocating motion in the above manner to consecutively output boosted pressurized fluid from the output port 44.

In accordance with the pressure booster 120 according to this embodiment, pressurized fluid is extracted from the first booster chamber 22*a* or the second booster chamber 22*b* of the booster cylinder 12 and supplied to predetermined ports of the first operating valve 48 and the second operating valve 52 in order to switch the positions of the operating valves. Since the pressure of pressurized fluid increased in the first booster chamber 22*a* or the second booster chamber 22*b* is higher than the pressure of the pressurized fluid supply source, the first operating valve 48 and the second operating valve 52 can be actuated more reliably.

The pressure booster according to the present invention is not limited in particular to the embodiments described above, and may have various structures without departing from the scope of the present invention as a matter of course.

The invention claimed is:

1. A pressure booster including a booster cylinder and drive cylinders disposed respectively on both sides of the booster cylinder, comprising:

a pair of pilot valves, each pilot valve configured to be actuated when a piston of the corresponding drive cylinder is in abutment with the pilot valve at a moving end of the piston; and a pair of operating valves, each operating valve configured to switch a state of supply of pressurized fluid from a pressurized fluid supply source between pressure chambers of the drive cylinders, wherein:

when each of the pilot valves is actuated, the pressurized fluid from the pressurized fluid supply source is supplied through the corresponding pilot valve, and from the corresponding pilot valve to the pair of operating valves, to thereby switch the state of supply of the pressurized fluid in the drive cylinders.

2. The pressure booster according to claim 1, wherein each of the operating valves switches between a state in which the pressurized fluid is supplied to the pressure chamber of the corresponding drive cylinder and pressurized fluid in a back pressure chamber of the corresponding drive cylinder is discharged, and a state in which part of the pressurized fluid in the pressure chamber of the corresponding drive cylinder is collected in the back pressure chamber of the corresponding drive cylinder.

3. The pressure booster according to claim 2, wherein:

each of the pilot valves includes a push rod configured to protrude to an inside of the back pressure chamber of the corresponding drive cylinder by a biasing force of a spring; and the piston of the corresponding drive cylinder comes into abutment with the push rod at the moving end.

4. The pressure booster according to claim 3, wherein a silencer is provided in a channel through which the pressurized fluid in each of the back pressure chambers of the drive cylinders is discharged.

5. The pressure booster according to claim 3, wherein:

each of the push rods includes a piston portion;

a space on a first side of the piston portion is exposed to an atmosphere while a space on a second side of the piston portion is connected to a pilot channel for switching the states of the pair of operating valves; and when the piston of each of the drive cylinders is not in abutment with the push rod, the space on the first side and the space on the second side communicate with each other via a hole formed inside the push rod.

6. The pressure booster according to claim 5, wherein:

each of the pilot valves includes a valve element with which the corresponding push rod is abuttable; and when the piston of each of the drive cylinders comes into abutment with the push rod and then brings the push rod into abutment with the valve element, the space on the second side is connected to the pressurized fluid supply source and is sealed from the hole formed inside the push rod.

7. The pressure booster according to claim 5, wherein:

each of the push rods is slidably disposed inside a valve seat and a valve seat retainer;

a first end face of the valve seat retainer faces the back pressure chamber of the corresponding drive cylinder while a second end face thereof is in abutment with the valve seat; and the space on the first side includes a groove formed on the second end face of the valve seat retainer.

8. A pressure booster including a booster cylinder and drive cylinders disposed respectively on both sides of the booster cylinder, comprising:

a pair of pilot valves, each pilot valve configured to be actuated when a piston of the corresponding drive cylinder is in abutment with the pilot valve at a moving end of the piston; and a pair of operating valves, each operating valve configured to switch a state of supply of pressurized fluid from a pressurized fluid supply source between pressure chambers of the drive cylinders, wherein:

when each of the pilot valves is actuated, pressurized fluid from the booster cylinder is supplied through the corresponding pilot valve, and from the corresponding pilot valve to the pair of operating valves, to thereby switch the state of supply of the pressurized fluid from the pressurized fluid supply source, in the drive cylinders.

9. The pressure booster according to claim 8, wherein each of the operating valves switches between a state in which the pressurized fluid from the pressurized fluid supply source is supplied to the pressure chamber of the corresponding drive cylinder and pressurized fluid in a back pressure chamber of the corresponding drive cylinder is discharged, and a state in which part of the pressurized fluid in the pressure chamber of the corresponding drive cylinder is collected in the back pressure chamber of the corresponding drive cylinder.

10. The pressure booster according to claim 9, wherein:

each of the pilot valves includes a push rod configured to protrude to an inside of the back pressure chamber of the corresponding drive cylinder by a biasing force of a spring; and the piston of the corresponding drive cylinder comes into abutment with the push rod at the moving end.

11. The pressure booster according to claim 10, wherein a silencer is provided in a channel through which the pressurized fluid in each of the back pressure chambers of the drive cylinders is discharged.

12. The pressure booster according to claim 10, wherein:

each of the push rods includes a piston portion;

a space on a first side of the piston portion is exposed to an atmosphere while a space on a second side of the piston portion is connected to a pilot channel for switching the states of the pair of operating valves; and when the piston of each of the drive cylinders is not in abutment with the push rod, the space on the first side and the space on the second side communicate with each other via a hole formed inside the push rod.

13. The pressure booster according to claim 12, wherein:

each of the pilot valves includes a valve element with which the corresponding push rod is abuttable; and when the piston of each of the drive cylinders comes into abutment with the push rod and then brings the push rod into abutment with the valve element, the space on the second side is connected to a corresponding booster chamber of the booster cylinder and is sealed from the hole formed inside the push rod.

14. The pressure booster according to claim 12, wherein:

each of the push rods is slidably disposed inside a valve seat and a valve seat retainer;

a first end face of the valve seat retainer faces the back pressure chamber of the corresponding drive cylinder while a second end face thereof is in abutment with the valve seat; and the space on the first side includes a groove formed on the second end face of the valve seat retainer.

* * * * *